US005685161A

United States Patent [19]

Peckjian et al.

[11] Patent Number: 5,685,161

[45] Date of Patent: Nov. 11, 1997

[54] REFRIGERANT RECOVERY AND RECYCLING APPARATUS

[75] Inventors: Bryan M. Peckjian, Huntingdon Valley, Pa.; Michel J. Maniez, Cadenet, France; Pyotr Gerasimov, Frederick, Md.

[73] Assignee: National Refrigeration Products, Bensalem, Pa.

[21] Appl. No.: 591,045

[22] Filed: Jan. 25, 1996

[51] Int. Cl.[6] ..... F25B 45/00

[52] U.S. Cl. ..... 62/149; 62/292

[58] Field of Search ..... 62/149, 292, 475, 62/77, 85

[56] References Cited

U.S. PATENT DOCUMENTS

| | | | |
|---|---|---|---|
| 2,532,452 | 12/1950 | Hoesel . | |
| 3,232,070 | 2/1966 | Sparano et al. . | |
| 3,425,238 | 2/1969 | Sylvan . | |
| 4,170,116 | 10/1979 | Williams . | |
| 4,242,878 | 1/1981 | Brinkerhoff . | |
| 4,261,178 | 4/1981 | Cain . | |
| 4,285,206 | 8/1981 | Koser . | |
| 4,363,222 | 12/1982 | Cain . | |
| 4,412,431 | 11/1983 | Waldrep . | |
| 4,458,497 | 7/1984 | Kubic . | |
| 4,476,688 | 10/1984 | Goddard . | |
| 4,476,693 | 10/1984 | Johnson . | |
| 4,480,446 | 11/1984 | Margulefsky et al. . | |
| 4,513,578 | 4/1985 | Proctor et al. . | |
| 4,550,573 | 11/1985 | Rannenberg . | |
| 4,566,291 | 1/1986 | Halavais . | |
| 4,584,838 | 4/1986 | AbuJudom, II . | |
| 4,688,388 | 8/1987 | Lower et al. . | |
| 4,766,733 | 8/1988 | Scuderi . | |
| 4,805,416 | 2/1989 | Manz et al. . | |
| 4,809,515 | 3/1989 | Houwink . | |
| 4,809,520 | 3/1989 | Manz et al. . | |
| 4,856,289 | 8/1989 | Lofland . | |
| 4,856,290 | 8/1989 | Rodda . | |
| 4,934,390 | 6/1990 | Sapp . | |
| 4,938,031 | 7/1990 | Manz et al. . | |
| 4,942,741 | 7/1990 | Hancock et al. . | |
| 4,969,495 | 11/1990 | Grant . | |
| 4,996,848 | 3/1991 | Nelson et al. . | |
| 4,998,413 | 3/1991 | Sato et al. . | |
| 5,020,331 | 6/1991 | Michny . | |
| 5,046,320 | 9/1991 | Loose et al. . | |
| 5,095,713 | 3/1992 | Laukhuf et al. . | |
| 5,127,239 | 7/1992 | Manz et al. . | |
| 5,146,761 | 9/1992 | Cavanaugh et al. . | |
| 5,170,632 | 12/1992 | Reilly, Jr. et al. . | |
| 5,172,562 | 12/1992 | Manz et al. . | |
| 5,203,177 | 4/1993 | Manz et al. | 62/149 |
| 5,209,077 | 5/1993 | Manz et al. | 62/149 |
| 5,230,224 | 7/1993 | Ricketts et al. . | |
| 5,247,802 | 9/1993 | Maniez et al. . | |
| 5,282,366 | 2/1994 | Reilly, Jr. et al. . | |
| 5,363,662 | 11/1994 | Todack | 62/149 |

*Primary Examiner*—John M. Sollecito

*Attorney, Agent, or Firm*—Dickstein Shapiro Morin & Oshinsky LLP

[57] ABSTRACT

A refrigerant recovery and recycling apparatus which transfers refrigerant from a first container to a second container. The refrigerant recovery and recycling apparatus comprises a compressor having a suction side and a discharge side. The suction side of the compressor is in fluid communication with the first container, and the discharge side is in fluid communication with the second container. A liquid/vapor sensor is connected to the first container to detect whether the refrigerant from the first container is in a liquid state or a vapor state. A heater is located between the first container and the suction side of the compressor. The heater is responsive to the liquid/vapor sensor to vaporize liquid refrigerant from the first container. A condenser having an inlet and an outlet is provided. The inlet of the condenser is in fluid communication with the discharge side of the compressor. A filter having an inlet and an outlet is also provided. The inlet of the filter is in fluid communication with the outlet of the condenser, and the outlet of the filter is in fluid communication with the second container.

14 Claims, 2 Drawing Sheets

REFRIGERANT RECOVERY AND RECYCLING APPARATUS

FIELD OF THE INVENTION

The present invention relates to an apparatus and method for recovering and recycling refrigerant. More particularly, the present invention provides a portable refrigerant recovery and recycling unit for recovering and recycling refrigerant in a single operation, and then clearing refrigerant from the recycling apparatus.

BACKGROUND OF THE INVENTION

Commercial and residential refrigeration systems, such as refrigerators, air conditioners, heat pumps and other small air-conditioning and refrigeration systems use chlorofluorocarbons (CFC's) as a standard heat-transfer media. For many years, when a refrigeration system needed servicing, it was common practice in the industry to simply release the refrigerant to the atmosphere. That practice is no longer acceptable, nor is it responsible to abandon CFC-containing equipment because it would eventually leak out. It has thus become increasingly desirable to service CFC-containing units in a manner which prevents any loss of CFC's to the atmosphere or the environment, and to remove CFC's from non-serviceable units before the refrigerant leaks out.

Several systems have been proposed for evacuating a charged refrigeration system of its refrigerant, and storing it in a receiving container.

One known system provides a portable refrigerant recovery system which consists of an evaporator, a compressor, a condenser and a refrigerant storage container mounted on a two-wheeled hand truck. Refrigerant is passed through the evaporator, compressed by the compressor, reliquified in the condenser and passed to a storage container.

Another known system for withdrawing and charging refrigerant from or into a refrigeration system passes the withdrawn refrigerant through a vaporizing coil to prevent liquid refrigerant from entering a positive displacement transfer pump. Refrigerant vapor from the pump outlet is liquified in a cooling coil/heat exchanger, which is in communication with a refrigerant storage container.

Another known refrigerant reclamation and charging unit has a compressor and a condenser, and is operated in two different configurations, depending on whether liquid refrigerant or vaporized refrigerant is being removed. Liquid refrigerant is removed from a disabled refrigeration unit directly to a storage container by forcing vaporized refrigerant from the refrigerant recovery system compressor into the disabled refrigeration unit. After all the liquid refrigerant has been removed from the disabled refrigeration unit, the hoses are re-configured such that the compressor pulls a vacuum on the disabled refrigeration unit to remove the vaporized refrigerant.

Another known system for recovering and purifying refrigerant from a disabled refrigeration unit initially passes the recovered refrigerant through an oil trap and acid purification filter-dryer to remove impurities before the refrigerant gas enters the compressor. The compressed gas is passed through a condenser and converted to a liquid. The liquified refrigerant is then passed to an acid-purification filter-dryer and into a receiving tank. The level of refrigerant within the receiving tank is not monitored, and no control means is provided to control refrigerant input in the system based upon the level of refrigerant in the recovery tank. The liquified gas may be discharged to an external holding tank or a portion of the liquified gas may be used to cool the gas in the condenser coils. A high-pressure purge feature allows residual refrigerant in the system to be purged to the atmosphere.

It would be desirable to withdraw both liquid and vaporized refrigerant from a disabled refrigeration unit without requiring the operator to change hoses or readjust the recovery equipment. It would also be desirable to provide an apparatus and method for recovering and recycling refrigerant in a single operation to remove contaminants such that the refrigerant meets the requirements of the industry recycling guidelines (IRG-2) and the Air-Conditioning and Refrigeration Institute Standard 740 concerning water, chloride ion, acidity, nonboiling residues and particulates/solids. It would also be desirable to clear refrigerant from the recovery system after the recovery and recycling operation has been completed.

The present invention is the result of observation of the limitations in the prior devices, and efforts to solve them.

SUMMARY OF THE INVENTION

Briefly, the present invention provides a refrigerant recovery and recycling apparatus for transferring refrigerant from a first container to a second container. The refrigerant recovery and recycling apparatus comprises a compressor having a suction side and a discharge side. The suction side of the compressor is in fluid communication with the first container, and the discharge side is in fluid communication with the second container. A liquid/vapor sensor is fluidly connected to the first container to detect whether refrigerant passing into the apparatus is in a liquid state or a vapor state. A heater is located between the first container and the suction side of the compressor. The heater is responsive to the liquid/vapor sensor to vaporize liquid refrigerant passing into the apparatus from the first container. A condenser having an inlet and an outlet is provided. The inlet of the condenser is in fluid communication with the discharge side of the compressor. A filter having an inlet and an outlet is also provided. The inlet of the filter is in fluid communication with the outlet of the condenser, and the outlet of the filter is in fluid communication with the second container.

Another aspect of the present invention is a refrigerant recovery and recycling apparatus for transferring refrigerant from a first container to a second container. The refrigerant recovery and recycling apparatus comprises a compressor having a suction side and a discharge side. A first releasable hose coupling exposed on the apparatus is in fluid communication with the suction side of the compressor, and a second releasable hose coupling exposed on the apparatus is in fluid communication with the discharge side. A liquid/vapor sensor is fluidly coupled between the first hose coupling and the suction side of the compressor, and is suitably positioned to detect whether refrigerant passing into the apparatus through the first coupling is in a liquid state or a vapor state. A heater is located between the first coupling and the suction side of the compressor. The heater is responsive to the liquid/vapor sensor to vaporize liquid refrigerant passing through the first hose coupling into the apparatus. A condenser having an inlet and an outlet is provided. The inlet of the condenser is in fluid communication with the discharge side of the compressor. A filter having an inlet and an outlet is also provided. The inlet of the filter is in fluid communication with the outlet of the condenser, and the outlet of the filter is in fluid communication with the second hose coupling.

A further aspect of the present invention is a method for recovering and recycling refrigerant from a first container and storing the refrigerant in a second container. The method comprises the steps of: removing refrigerant from the first container; determining if the refrigerant from the first container is in a liquid state or a vapor state; heating the refrigerant from the first container which is in the liquid state to form a vaporized refrigerant at a relatively low temperature and low pressure; compressing the low-temperature, low-pressure vaporized refrigerant to form a relatively high-temperature, high-pressure vaporized refrigerant; vaporizing additional low-temperature, low-pressure refrigerant in the liquid state with heat from the high-temperature, high-pressure vaporized refrigerant; condensing the high-temperature, high-pressure refrigerant; passing the condensed refrigerant through a filter and into the second container; compressing the refrigerant from the first container in the vapor state to form a relatively high-temperature, high-pressure vaporized refrigerant; condensing the high-temperature, high-pressure refrigerant; and passing the condensed refrigerant through the filter and into the second container.

A further aspect of the present invention is a method of clearing trapped refrigerant from a refrigerant recovery and recycling apparatus. The refrigerant recovery and recycling apparatus is provided with a compressor with a suction side adapted for connection to a first container through a series of suction conduits, and a discharge side adapted for connection to a second container through a series of discharge conduits. The method comprises the steps of: providing a by-pass conduit between the discharge side of the compressor and the second container; providing a fluid flow path between the suction and discharge conduits and the suction side of the compressor; drawing a vacuum with the compressor in the suction and discharge conduits; filtering the refrigerant as it is drawn to the suction side of the compressor; and discharging the filtered refrigerant through the by-pass conduit.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
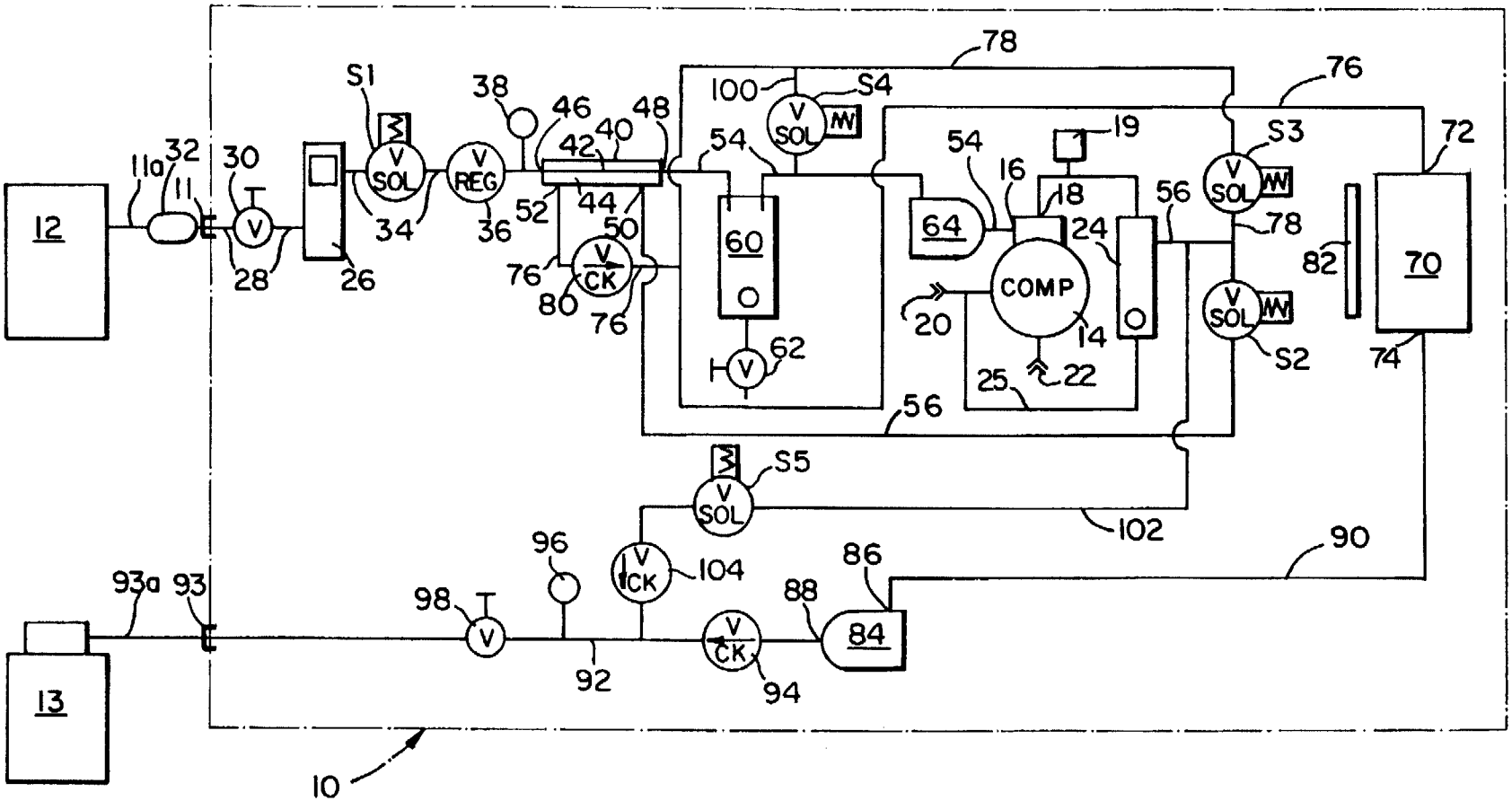
FIG. 1 is a schematic diagram of a refrigerant recovery and recycling apparatus in accordance with the present invention.

Certain terminology is used in the following description for convenience only, and is not limiting. The words "right," "left," "lower" and "upper" designate directions in the drawings to which reference is made. The words "inwardly" and "outwardly" refer to directions toward and away from, respectively, the geometric center of the refrigerant recovery and recycling apparatus and designated parts thereof. The terminology includes the words above specifically mentioned, derivatives thereof and words of similar import.

Referring to the drawings, wherein like numerals indicate like elements throughout, there is shown in FIG. 1 a preferred embodiment of a refrigerant recovery and recycling apparatus, generally designated 10 (hereinafter the "refrigerant recycling apparatus 10"), in accordance with the present invention.

Referring to FIG. 1, the refrigerant recycling apparatus 10 is used for transferring refrigerant from a first container 12 to a second container 13. The first container 12 may be a small appliance, such as a household refrigerator, air-conditioning unit, or heat pump, or any other small air-conditioning and/or refrigeration system well known to those of ordinary skill in the art. The present invention is also not limited to use with the specific types of refrigerant containers discussed above, and may also be used to recover refrigerant from automotive air conditioners, for example, as is understood by the ordinarily skilled artisan. The second container 13 is typically a transportable recovery tank in which the recovered, recycled refrigerant can be removed.

The refrigerant to be transferred is preferably of the high-pressure type, which exists as both a liquid and a gas at room temperature within the pressurized first container 12. Preferably, refrigerants such as R-12, R22, R-500, R-502, and R-134A may be recovered and recycled by use of the present invention. Those of ordinary skill in the art will understand from the present disclosure that a wide variety of refrigerants, too numerous to mention, may also be transferred and recycled in accordance with the present invention.

Still with reference to FIG. 1, the refrigerant recycling apparatus 10 (encompassed in phantom lines) includes a compressor 14 having a suction side 16 and a discharge side 18. Preferably, the compressor 14 is driven by a motor (not shown). The suction side 16 of the compressor 14 is in fluid communication with the first container 12. The discharge side 18 of the compressor 14 is in fluid communication with the second container 13. The compressor 14 is configured to produce a first relatively lower pressure or partial vacuum at the suction side 16 for drawing refrigerant into the compressor 14. The compressor 14 transfers the refrigerant through the remainder of the refrigerant recycling apparatus 10 by expelling refrigerant from the discharge side 18 at a second pressure, above the atmospheric pressure, and above the pressure of the suction side 16 of the compressor 14.

The compressor 14 is provided with an oil fill port 20 and an oil drain port 22. The refrigerant recycling apparatus 10 may be used to recover different types of refrigerants without changing the compressor oil. However, if refrigerant is transferred from a burned-out unit, the oil should be changed. The normal oil charge for the compressor is approximately 14–16 oz., and since a small amount of compressor oil may dissipate during operation, the compressor 14 includes a sight glass (not shown) for monitoring the level of the oil in the compressor 14. In the event that the level of oil is insufficient, oil may be added through the oil-charging port 20 in a manner understood by those of ordinary skill in the art.

Preferably, the apparatus 10 is provided with an oil separator 24, which separates oil from the vaporized refrigerant as it exits the discharge side 18 of the compressor 14, and returns the oil through an oil-return line 25 to the oil-charging port 20. A high-pressure cut-out switch 19 is provided on the discharge side 18 of the compressor 14 to monitor the refrigerant pressure on the discharge side 18 of the compressor 14 and stop the compressor 14 if the discharge pressure exceeds a predetermined limit such as 375 psi.

Preferably, the compressor 14 has a capacity so that the refrigerant recycling apparatus 10 is capable of recovering at least about 0.6 lbs./min. of refrigerant from the first container 12. However, it is understood by those of ordinary skill in the art from the present disclosure that the transfer rate may vary depending upon the type and capacity of the compressor, the other equipment selected and the type of refrigerant being transferred. It is similarly understood that other means could be utilized to recover liquid and/or vapor refrigerant from the container 12, such as a liquid/vapor pump. The specific internal configuration and elements of the compressor 14 are within the knowledge of those of ordinary skill in the art. Further description is therefore omitted for convenience only, and is not believed to be necessary or limiting.

Still with reference to FIG. 1, a liquid/vapor sensor 26 is connected to the first container 12 to detect whether the refrigerant from the first container 12 is in a liquid state or a vapor state. Preferably, the liquid/vapor sensor 26 is comprised of a float switch which is in fluid communication with the first container 12 through a first conduit 28. Preferably, the float switch is of a construction which is generally known to those of ordinary skill in the art, having a float positioned within a closed container such that when a liquid refrigerant enters the container, the float rises on the liquid refrigerant and causes a switch to signal that liquid refrigerant is present, by opening or closing the switch. If the refrigerant is in a vapor state, the float remains on the bottom of the container, and the switch remains closed, as explained in more detail below. This type of liquid/vapor sensor is known to those of ordinary skill in the art, and accordingly, further description is not believed necessary or limiting. It is similarly understood by those of ordinary skill in the art that other types of liquid/vapor sensors could be provided, such as a photometer/receiver pair which detects a change in the emitted light intensity depending upon whether the refrigerant is in a liquid or a vapor state, or other suitable sensor means.

Preferably, the first conduit 28 includes a manual shut-off valve 30. Preferably, a pre-filter cartridge 32 is also located between the liquid/vapor sensor 26 and the first tank 12. Actual connection between the apparatus 10 and first container is conventional, through a refrigerant hose 11 having releasable hose fittings at either end (not shown). An inlet hose fitting 11*a* is provided at the end of the first inlet conduit 28 and is exposed on the apparatus 10 to couple with an end of hose 11. Prefilter 32 can be located between hose 11 and fitting 11*a*. Preferably, the first conduit 28, and the other conduits of the apparatus 10 described hereinafter, are formed from copper tubing, unless otherwise indicated. However, it is understood by those of ordinary skill in the art, from the present disclosure, that the first conduit 28 may be made from any other suitable material which is impervious to the refrigerant to be transferred, such as suitable polymeric or metallic materials.

Preferably, the valve 30 is a hand-operated ball valve. However, it is understood by those of ordinary skill in the art, from the present disclosure, that other types of valves may be used, such as an automatically controlled solenoid valve, or a gate valve. Preferably, the pre-filter cartridge 32 is a particle filter which traps particulate matter in the refrigerant being drawn from the first container 12 to prevent malfunctioning of the components of the refrigerant recycling apparatus 10. Pre-filter cartridges such as ALCO #ALF-032, PARKER #PF052-MF, or SPORLAN #C-052 are used in conjunction with the preferred embodiment. However, it is understood by those of ordinary skill in the art from the present disclosure that other suitable pre-filters can be used, if desired.

A first valve S1, which is actuatable between an open and a closed state, is provided in fluid communication with the liquid/vapor sensor 26 via a second conduit 34. Preferably, the first valve S1 is a solenoid valve which can be remotely actuated between the open and closed states, and is of a type which is known to those of ordinary skill in the art. However, it is understood from the present disclosure that other types of valves, such as a pneumatically actuated or manually actuated valves, may be used in accordance with the present invention, if desired, depending on the specific recovery system design.

Still with reference to FIG. 1, a pressure regulator 36 and a pressure indicator or gauge 38 are in fluid communication with the second conduit 34. The pressure regulator 36 and the pressure gauge 38 are used to regulate and monitor the pressure of the refrigerant which is being transferred by the compressor 14. Preferably, the pressure regulator 36 is a standard pressure-regulating valve of the type generally known to those of ordinary skill in the art. The use of the pressure regulator 36 allows the transfer of refrigerants having a higher vapor pressure than R-12, such as R-22, R134A, R-500, and R-502, without damaging the compressor 14.

A heater indicated generally at 40 is located between the first container 12 and the suction side 16 of the compressor 14. The heater 40 is responsive to the liquid/vapor sensor 26 to vaporize liquid refrigerant from the first container 12. Preferably, the heater 40 is a heat exchanger having two fluid paths 42 and 44. The first fluid path 42 includes an inlet 46 and an outlet 48, and the second fluid path includes an inlet 50 and an outlet 52. The inlet 46 of the first fluid path 42 of the heat exchanger 40 is in fluid communication with the second conduit 34, and the outlet 48 of the first fluid path 42 of the heat exchanger 40 is in fluid communication with the suction side 16 of the compressor 14 via a third conduit 54. The inlet 50 of the second fluid path 44 of the heat exchanger 40 is in fluid communication with the discharge side 18 of the compressor 14 through a fourth conduit 56. As will be explained in detail below, the heat exchanger 40 is used to vaporize liquid refrigerant from the first container 12 detected by the liquid/vapor sensor 26 by passing high temperature refrigerant through the second fluid path 44.

While the heater 40 in the preferred embodiment is a heat exchanger as described above, it is understood by those of ordinary skill in the art that other types of heaters, such as an electrical-resistance heater, could be used in place of the heat exchanger 40, if desired.

Still with reference to FIG. 1, a contaminant accumulator 60 is located in the third conduit 54 between the outlet 48 of the first fluid path 42 of the heat exchanger 4, and the suction side 16 of compressor 14 to remove contaminants from the refrigerant. Preferably, a drain valve 62 is provided on the contaminant accumulator 60 to drain the accumulated contaminants.

A first filter 64 is provided in fluid communication between the suction side 16 of the compressor 14 and the first container 12. Preferably, the first filter 64 is located in the third conduit 54 between the contaminant accumulator 60 and the suction side 16 of the compressor 14. Preferably, the first filter 64 includes a molecular sieve to absorb moisture, and an activated element to neutralize acids in the refrigerant. One such filter, which is presently preferred, is part No. RH-48 from ALCO Controls, St. Louis, Mo. However, it is understood by those of ordinary skill in the art, from the present disclosure, that other types of molecular sieves and/or acid-absorbing filters can be utilized, if desired.

Still with reference to FIG. 1, a second valve S2, which is actuatable between an open and a closed state, is located in the fourth conduit 56 between the second fluid path 44 of the heat exchanger 40 and the discharge side 18 of the compressor 14. The second valve S2 is responsive to the liquid/vapor sensor 26 and is opened when liquid refrigerant is detected by the liquid/vapor sensor 26.

Preferably, the second valve S2 is a solenoid valve similar to the first valve S1. However, it is understood by those of ordinary skill in the art from the present disclosure that the valve S2 could be a pneumatically actuated or hand-actuatable valve, if desired.

As best shown in FIG. 1, the refrigerant recycling apparatus 10 includes a condenser 70 having an inlet 72 and an outlet 74. The inlet 72 of the condenser 70 is in fluid communication with the discharge side 18 of the compressor 14. Preferably, the inlet 72 of the condenser 70 is in fluid communication with the outlet 52 of the second fluid path 44 of the heat exchanger 40 via a fifth conduit 76. The inlet 72 of the condenser 70 is also in fluid communication with the discharge side 18 of the compressor 14 through a sixth conduit 78, which preferably intersects the fifth conduit 76. A check valve 80 is provided in the fifth conduit 76 between the outlet 52 of the second fluid path 44 of the heat exchanger 40, and the intersection of the sixth conduit 78. The check valve 80 prevents back flow of refrigerant into the outlet 52 of the second fluid path 44 of the heat exchanger 40. Preferably, a fan 82 is provided adjacent to the condenser 70 to generate an air flow over the condenser 70.

A third valve S3, which is actuatable between an open and a closed state, is located in the sixth conduit 78. The third valve S3 is open when the liquid/vapor sensor 26 detects refrigerant from the first container 12 in the vapor state. Preferably, the third valve S3 is a solenoid actuated valve of the type generally known to those of ordinary skill in the art. However, it is understood from the present disclosure that the third valve S3 may be a pneumatically actuatable or manually actuatable valve, if desired.

Still with reference to FIG. 1, the refrigerant recycling apparatus 10 includes a second filter 84 having an inlet 86 and an outlet 88. The inlet 86 of the second filter 84 is in fluid communication with the outlet 74 of the condenser 70. Preferably, the inlet 86 of the second filter 84 is in fluid communication with the outlet 74 of the condenser 70 via a seventh conduit 90. The outlet 88 of the second filter 84 is in fluid communication with the second container 13, preferably via an eighth "main discharge" conduit 92. Again, the actual physical fluid coupling between apparatus 10 and second container 13 is through a conventional discharge hose fitting 93 at the end of the main discharge conduit 92, exposed on the apparatus for releasable coupling with a conventional discharge hose 93*a*. A check valve 94 is provided in the eighth, main discharge conduit 92 between the outlet 88 of the second filter 84 and the second container 13. A pressure gauge 96 and a manual shut-off valve 98 are located in the eighth, main discharge conduit 92 between the check valve 94 and the second container 13.

Preferably, the second filter 84 comprises a molecular sieve to remove moisture from the refrigerant, and an activated element to remove acid and other contaminants from the refrigerant. The check valve 94, pressure gauge 96 and the manually actuated shut-off valve 98 are of the type which is generally known to those of ordinary skill in the art and, accordingly, further description is not believed to be necessary or limiting. The pressure gauge 96 provides the pressure of the refrigerant in the second container 13 and the shut-off valve 98 is used to close the system prior to removing the second container 13. Those of ordinary skill in the art will understand that other types of valves may be used in place of the manually actuatable shut-off valve 98, such as a solenoid valve.

Still with reference to FIG. 1, the refrigerant recycling apparatus 10 further includes a ninth conduit 100 in fluid communication between the third conduit 54 and the sixth conduit 78. A fourth valve S4, actuatable between an open and a closed state, is located in the ninth conduit 100. A tenth conduit 102 is provided in fluid communication between the discharge side 18 of the compressor 14 and the second container 13.

A fifth valve S5, actuatable between an open and a closed state, is located in the tenth conduit 102. Preferably, the tenth conduit 102 has a first end which intersects the fourth conduit 56 in a position between the compressor 14 and the second valve S2, and a second end which intersects the eighth, discharge conduit 92 in a position after the check valve 94. A check valve 104 is provided in the tenth conduit 102 between the fifth valve S5 and the intersection with the discharge conduit 92.

In the preferred embodiment, the fourth and fifth valves S4 and S5 are solenoid valves of the type generally known to those of ordinary skill in the art. However, it is understood from the present disclosure that the fourth and fifth valves S4 and S5 could be pneumatically-actuated or manually-actuated valves.

Figure 2:
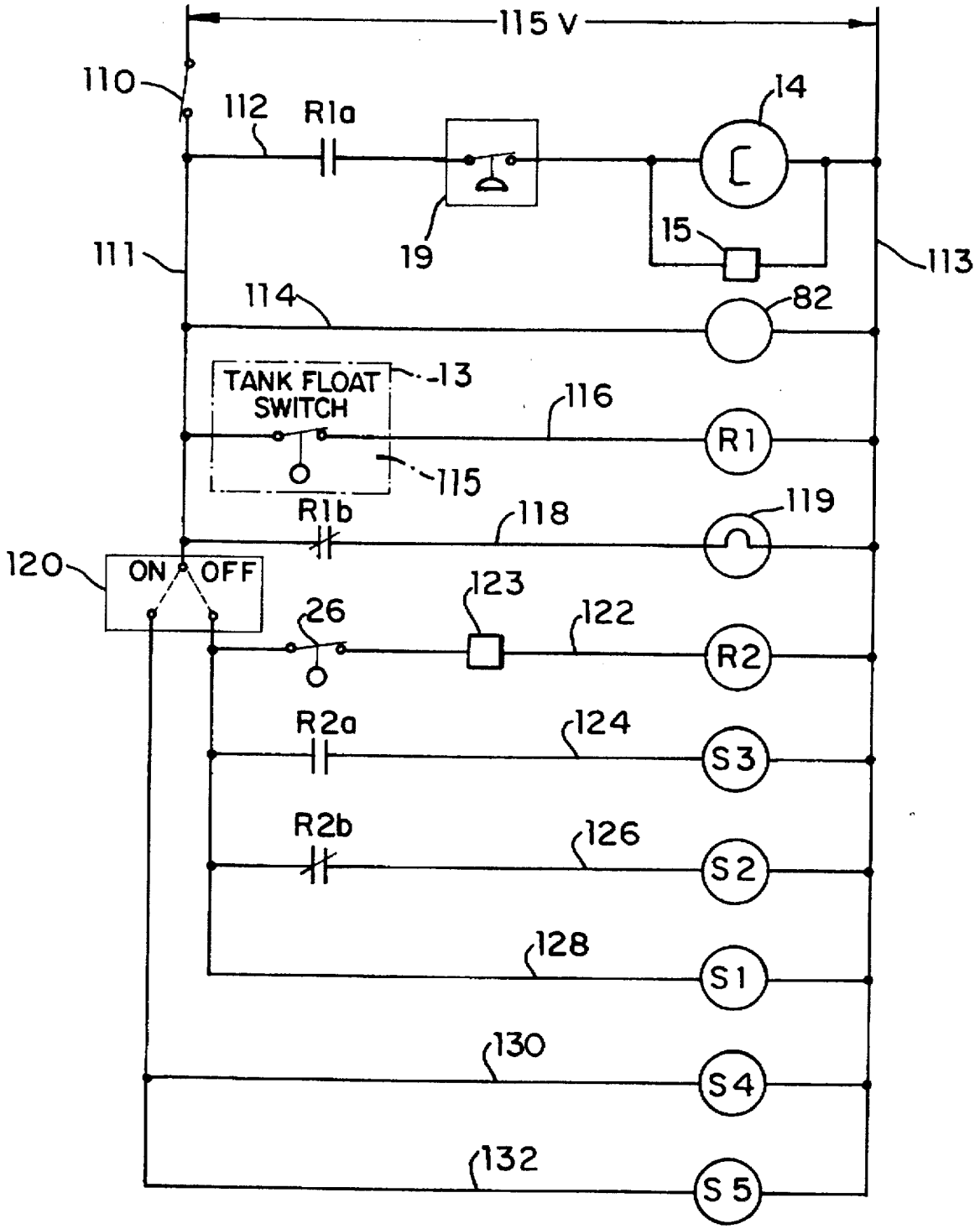
FIG. 2 is a schematic wiring diagram of the refrigerant recovery and recycling apparatus.

Referring now to FIG. 2, a schematic wiring diagram for the refrigerant recycling apparatus 10 is shown. An ON/OFF switch 110 is connected across a power source, which is preferably a 115 V AC source, to control power to the refrigerant recycling apparatus 10. When the switch 110 is in the ON position (as shown), power is provided by conductors 111, 113 to the parallel circuit as described below.

The first circuit element 112, which is electrically connected in parallel between conductors 111 and 113, provides power to the compressor 14. The first circuit element 112 comprises a first switch R1*a* of a first relay R1, described in detail below, electrically connected in series with the high pressure cut-out switch 19 and the motor for the compressor 14. The first relay switch R1*a* of the first relay R1 is normally closed and maintains the electrical connection through the first circuit element 112 when the tank float switch 115 in the second tank 13 indicates the second container 13 is not full, as described in more detail below. When the second container 13 is full, the first relay switch R1*a* is opened and interrupts the electrical connection to the motor for the compressor 14. The electrical connection through the first circuit 112 is also interrupted when the high pressure cut-out switch 19 detects a compressor discharge pressure above a predetermined level. A timer 15, preferably an hour gauge, is electrically connected to the first circuit 112 in parallel with the motor for the compressor 14 to clock the number of hours which the compressor is on.

A second circuit element 114 is provided between the conductors 111 and 113 to provide power to the fan 82 when the switch 110 is on.

A third circuit element 116 is provided between the conductors 111 and 113. The third circuit element comprises a tank float switch 115 from the second container 13 electrically connected in series with the first relay R1. When the second container 13 is full, the tank float switch 115 opens, interrupting the electrical connection to the relay R1. The first relay R1 then causes the first relay switch R1*a* to open, as described above, to interrupt power to the compressor 12.

A fourth circuit element 118 is provided between the conductors 111 and 113. The fourth circuit element comprises an indicator bulb 119 electrically connected in series to a second relay switch R1*b* of the first relay R1. The indicator bulb 119 indicates when the second tank 13 is full (typically to eighty percent capacity). The second relay switch R1*b* of first relay R1 is normally open, such that no electrical connection is provided to the indicator bulb 119. When the tank float switch 115 opens, interrupting the electrical connection to the first relay R1 of the third circuit element 116, the second switch R1*b* of the first relay R1 closes to provide an electrical connection to illuminate the indicator bulb 119.

A pump-out switch 120 having ON and OFF positions is provided and a common pole is electrically connected to the conductor 111. When the pump-out switch 120 is in the "OFF" position, electrical power is provided to fifth, sixth, seventh and eighth circuit elements 122, 124, 126 and 128, respectively, which are connected in parallel between the "OFF" pole of the switch 120 and the second conductor 113. When the pump-out switch 120 is in the "ON" position, power is provided to the ninth and tenth circuit elements 130 and 132, which are connected in parallel between the "ON" pole of the switch 120 and the second conductor 113.

The fifth circuit element 122 includes the liquid/vapor sensor 26, which is wired in series with a timer 123 and a second relay R2. When the liquid/vapor sensor 26 is closed, indicating that only vapor is present, power is provided to the timer 123 and the second relay R2. In the preferred embodiment, the timer 123 checks whether the liquid/vapor sensor 26 is closed for at least three seconds prior to providing current to the second relay R2 to eliminate repeated on/off switching of the second relay R2.

The sixth circuit element 124 includes a first relay switch R2*a* of the second relay R2 which is connected in series with the third solenoid valve S3. When the pump-out switch 120 is in the "OFF" position, and power is provided to the second relay R2 (i.e. the liquid/vapor sensor 26 detects vapor), the first relay switch R2*a* of the second relay R2 is closed and the electrical connection is maintained through the sixth circuit element 124 and the third solenoid valve S3 is actuated to an open position.

The seventh circuit element 126 includes a second relay switch R2*b* of the second relay R2 which is connected in series with the second solenoid valve S2. When the pump-out switch 120 is in the *OFF* position and power is provided to the second relay R2 (i.e. the liquid/vapor sensor 26 detects vapor), the second relay switch R2*b* of the second relay R2 is open, interrupting the electrical connection through the seventh circuit element 126, and the second solenoid valve S2 remains closed.

When the liquid/vapor sensor 26 detects liquid refrigerant, the liquid/vapor sensor 26 interrupts the electrical connection through the fifth circuit element 122. In response, the first relay switch R2*a* of the second relay R2 opens, interrupting the electrical continuity in the sixth circuit element 124, causing the third solenoid valve S3 to close, and the second relay switch R2*b* of the second relay R2 closes, providing electrical continuity through the seventh circuit element 126, causing the second solenoid valve S2 to open.

The eighth circuit element 128 provides power to the first solenoid valve S1 when the pump-out switch 120 is in the "OFF" position, causing the solenoid valve S1 to be open.

When the pump-out switch 120 is changed to the "ON" position, power to the fifth, sixth, seventh and eighth circuit elements 122, 124, 126 and 128 is interrupted, causing the first, second and third valves S1, S2 and S3 to close, and electrical power is provided to the ninth and tenth branch circuit elements 130 and 132. The ninth circuit element 130 comprises the fourth solenoid valve S4, and the tenth circuit element 132 comprises the fifth solenoid valve S5. The fourth and fifth solenoid valves S4 and S5 open when the pump-out switch 120 is in the "ON" position.

It is understood by those of ordinary skill in the art that the various components, such as the valves, pressure gauges, sight glasses, filters and the like are standard items which are readily available, and are interconnected in a manner which is understood by those of ordinary skill in the art. Accordingly, further description is not believed to be necessary, and, therefore, is not provided for convenience only, and is not considered to be limiting.

The method for recovering and recycling refrigerant from the first container 12 and storing the refrigerant in a second container 13 according to the present invention will now be described generally with reference to FIGS. 1 and 2.

To prepare for refrigerant recovery from the first container 12, the first container 12 is connected to the first conduit 28 of the refrigerant recycling apparatus 10 through inlet hose 11*a* and inlet hose coupling 11. The first conduit 28 may be connected to the vapor port on the container 12, or to both the liquid and vapor ports on the container 12, if desired, for example, through a manifold (not shown). The valve (not shown) on the container 12 is opened, and the shut-off valve 30 on the refrigerant recycling apparatus 10 is opened. A second container 13 is connected through the outlet hose 93*a* and outlet hose fitting 93 to the discharge conduit 92 through the liquid port (not shown) on the second container 13.

Power is then provided to the refrigerant recycling apparatus 10 and the ON/OFF switch 110 is placed in the ON position to remove refrigerant from the first container 12. Power is provided to the compressor 14 through the first circuit element 112. The compressor 14 generates a relatively lower pressure at the suction side 16 to withdraw refrigerant from the first container 12. The refrigerant is drawn through the first conduit 28 into the liquid/vapor sensor 26 for determining if the refrigerant from the first container 12 is in a liquid state or a vapor state. If the refrigerant drawn from the first container 12 is in a liquid state, the liquid/vapor sensor 26 interrupts power through the fifth circuit element 122, causing the second relay R2 to open its first relay switch R2*a* and close its second relay switch R2*b*. In response to the second relay switch R2*b* of the second relay R2 closing, an electrical connection through the sixth circuit element 126 is established and the second solenoid valve S2 is opened, and the first relay switch R2*a* of the second relay R2 interrupts the electrical connection through the fifth circuit element 124, closing the third solenoid valve S3. The liquid refrigerant is drawn into the accumulator 60, and at least some of the liquid refrigerant boils off to form a vaporized refrigerant, which is drawn through the first filter 64 into the compressor 14. The compressor 14 discharges a relatively high-temperature, high-pressure vaporized refrigerant through the discharge side 18, which travels through the fourth conduit 56 and the second valve S2 to the second fluid path 44 of the heat exchanger 40. The high-temperature, high-pressure vaporized refrigerant heats the liquid refrigerant being drawn through the first path 42 of the heat exchanger 40 from the first container 12 to vaporize the liquid refrigerant. This relatively low-temperature, low-pressure vaporized refrigerant is drawn through the third conduit 54, the accumulator 60 and first filter 64 to the compressor 14 for compressing the low-temperature, low-pressure vaporized refrigerant, to continue forming the relatively high-temperature, high-pressure vaporized refrigerant as the process continues.

The high-temperature, high-pressure vaporized refrigerant is passed from the second fluid path 44 of the heat exchanger 40 to the fifth conduit 76, which carries it to the condenser 70, for condensing the high-temperature, high-pressure refrigerant to a liquid refrigerant. The liquid refrigerant is passed through the seventh conduit 90 and the second filter 84 into the second container 13.

In the event that the liquid/vapor sensor 26 detects refrigerant in the vapor state, for example, when the apparatus 10 is unable to draw any further liquid from the first container 12, the liquid vapor/sensor 26 creates and maintains the electrical connection through the fifth circuit element 122, providing electrical power to the second relay R2. The first relay switch R2*a* of the second relay R2 closes providing electrical power to the third solenoid valve S3, which opens. The second relay switch R2*b* of the second relay R2 opens, interrupting power to the second solenoid valve S2, which closes. In the event of waves or surges of liquid refrigerant 10, the apparatus 10, the timer 123 prevents repetitive on/off switching of the second relay R2 by providing a three second delay before providing power to the second relay R2. The refrigerant from the first container 12 which is in a vapor state is drawn through the first, second and third conduits 28, 34 and 54 to the compressor 14 for compressing the refrigerant to a relatively high-temperature, high-pressure vaporized refrigerant. The refrigerant passes through the third solenoid valve S3 and the sixth conduit 78 to bypass the heat exchanger 40, to the fifth conduit 76, which carries the refrigerant to the condenser 70 for condensing the high-temperature, high-pressure refrigerant. The condensed refrigerant is carried from the outlet 74 of the condenser 70 through the seventh conduit 90 and into the second container 13. The refrigerant is passed through the filter 84, which removes any remaining moisture and acidity from the condensed refrigerant, prior to passing the condensed refrigerant through the discharge conduit 92, the shut-off valve 98, and outlet hose 93 to the second container 13.

When the second container reaches eighty percent capacity, the tank float switch 115 opens, interrupting the electrical connection through the third circuit element 116 and the first relay coil R1. In response, the first relay switch R1*a* of the first relay R1 interrupts power through the first circuit element 112 to the motor for the compressor 14, and the second relay switch R1*b* of the first relay R1 closes, providing an electrical connection through the fourth circuit element 118, which lights the indicator panel light 119, to indicate that the second container 13 is full. The valve on the second container 13 and the shut-off valve 98 are closed, and the second container 13 is replaced with an empty container, in order to continue the removal and recycling of refrigerant from the first container 12.

This process continues until all the refrigerant within the first container 12 has been removed, as indicated by a reading of zero psi on the pressure gauge 38. The shut-off valves 30 and 98 are then closed, and the refrigerant recycling apparatus 10 can be disconnected from the first and second containers 12 and 13.

The present invention also provides a method of clearing trapped refrigerant from the refrigerant recycling apparatus 10, which includes the compressor 14 with the suction side 16 adapted for connection to the first container 12 through a series of suction conduits (28, 34 and 54) and the discharge side 18 adapted for connection to the second container 13 through a series of conduits (56, 76, 78, 90 and 92) collectively referred to as discharge conduits. The method comprises the steps of providing the tenth, bypass conduit 102, as described above, between the discharge side 18 of the compressor 14 and container 13, attached to the main discharge conduit 92. The first shut-off valve 30 is in the closed position, and the second shut-off valve 98 is in the open position, and power to the refrigerant recycling apparatus 10 is turned on by the switch 110, shown in FIG. 2. The pump-out switch 120 is then placed in the "ON" position, such that no power is provided to the fifth, sixth, seventh and eighth circuit elements 122, 124, 126 and 128, and the first, second and third valves S1, S2 and S3 are closed. Power is provided through the ninth and tenth circuit elements 130 and 132, causing the fourth and fifth valves S4 and S5 to open. With the fourth valve S4 being open, a fluid flow path is provided between the suction side 16 of the compressor 14 and the suction and discharge conduits 28, 34, 54, 56, 76, 78, 90, the oil separator 24, the sensor 26, the heater 40, the contaminant accumulator 60, first and second filters 64 and 84 and the condenser 70. The compressor 14 draws a vacuum in the suction and discharge conduits 28, 34, 54, 56, 76, 78 and 90. All of the refrigerant is drawn through the first filter 64 for filtering the refrigerant as it is drawn through suction side 16 of the compressor 14. With the second and third solenoid valves S2 and S3 in the closed position, the high-temperature, high-pressure vaporized refrigerant, discharged from the discharge side 18 of the compressor 14, passes through the tenth conduit 102, which acts as a by-pass conduit, through the fifth valve S5 and the check valve 104, into the second container 13. When the inlet pressure gauge 38 is down to ten inches of vacuum, pump-out is complete, and power to the refrigerant recycling apparatus 10 is turned off manually by the switch 110.

The composition of oil in recycled refrigerant is slightly higher during pump-out procedure, but is still lower than the requirements of the Industry Recycling Guidelines (IRG-2).

It has been found that the first filter 64 and the discharge filter 84 must be serviced after every four-and-one-half hours of refrigerant recovery/recycling in order to maintain peak performance of the refrigerant recycling apparatus 10. The amount of operating time is tracked by the hour gauge or other timer 15 wired in parallel with the compressor 14, as shown in FIG. 2.

Those of ordinary skill in the art will also understand from the present disclosure that the prefilter 32 should be used to avoid malfunctioning of the pressure regulator, liquid/vapor switch and solenoid valves through the introduction of particulate contaminants into the refrigerant recycling apparatus 10. Similarly, the refrigerant recycling apparatus 10 is like a refrigeration unit, and must not be open to the air. Accordingly, all valves on the refrigerant recycling apparatus 10 must be in a closed position when the refrigerant recycling apparatus 10 is not in use.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A refrigerant recovery and recycling apparatus for transferring refrigerant from a first container to a second container, the refrigerant recovery and recycling apparatus comprising:

a compressor having a suction side for fluid communication with the first container, and said compressor having a discharge side for fluid communication with the second container;

a liquid/vapor sensor for detecting whether the refrigerant from the first container is in a liquid state or a vapor state;

a heater responsive to the liquid/vapor sensor to vaporize liquid refrigerant from the first container; and a condenser having an inlet and an outlet, the inlet of the condenser being in fluid communication with the discharge side of the compressor.

2. The apparatus of claim 1 wherein the heater is comprised of a heat exchanger having two fluid paths, the first fluid path including an inlet and an outlet and the second fluid path including an inlet and an outlet, the inlet of the first fluid path of the heat exchanger being in fluid communication with the first container and the outlet of the first fluid path of the heat exchanger being in fluid communication with the suction side of the compressor, the inlet of the second fluid path of the heat exchanger being in fluid communication with the discharge side of the compressor, and wherein a second valve, actuatable between an open and closed state, is located between the second fluid path of the heat exchanger and the compressor, the second valve only being in the open state in response to the liquid/vapor sensor detection of refrigerant from the first container in the liquid state.

3. The apparatus of claim 2 wherein the heat exchanger is a tube in tube heat exchanger.

4. The apparatus of claim 1 further comprising a filter in fluid communication between the suction side of the compressor and the first container.

5. The apparatus of claim 1 wherein the liquid/vapor sensor is a float actuated switch.

6. A refrigerant recovery and recycling apparatus for transferring refrigerant from a first container to a second container, the refrigerant recovery and recycling apparatus comprising:

a compressor having a suction side and a discharge side;

a first releasable hose coupling in fluid communication with the suction side of the compressor;

a second releasable hose coupling exposed on the apparatus, the second hose coupling being in fluid communication with the discharge side;

a liquid/vapor sensor fluidly coupled between the first hose coupling and the suction side of the compressor, the liquid/vapor sensor being positioned to detect whether refrigerant passing into the apparatus through the first coupling is in a liquid state or a vapor state;

a heater located between the first hose coupling and the suction side of the compressor, the heater being responsive to the liquid/vapor sensor to vaporize liquid refrigerant passing through the first hose coupling into the apparatus;

a condenser having an inlet and an outlet, the inlet of the condenser being in fluid communication with the discharge side of the compressor; and a filter having an inlet and an outlet, the inlet of the filter being in fluid communication with the outlet of the condenser, and the outlet of the filter being in fluid communication with the second hose coupling.

7. A refrigerant recovery and recycling apparatus for transferring refrigerant from a first container to a second container, the refrigerant recovery and recycling apparatus comprising:

a compressor having a suction side and a discharge side, the suction side being in fluid communication with the first container, and the discharge side being in fluid communication with the second container;

a liquid/vapor sensor, which detects whether the refrigerant from the first container is in a liquid state or a vapor state, the liquid/vapor sensor being in fluid communication with the first container through a first conduit;

a first valve, actuatable between an open and a closed state, in fluid communication with the liquid/vapor sensor through a second conduit;

a heat exchanger having two fluid paths, the first fluid path including an inlet and an outlet and the second fluid path including an inlet and an outlet, the inlet of the first fluid path of the heat exchanger being in fluid communication with second conduit and the outlet of the first fluid path of the heat exchanger being in fluid communication with the suction side of the compressor through a third conduit, the inlet of the second fluid path of the heat exchanger being in fluid communication with the discharge side of the compressor through a fourth conduit;

a second valve, actuatable between an open and a closed state, located in the fourth conduit between the second fluid path of the heat exchanger and the compressor, the second valve only being in the open state in response to the liquid/vapor sensor detection of refrigerant from the first container in the liquid state;

a condenser having an inlet and an outlet, the inlet of the condenser being in fluid communication with the outlet of the second fluid path of the heat exchanger through a fifth conduit, the inlet of the condenser also being in fluid communication with the discharge side of the compressor through a sixth conduit; and a third valve, actuatable between an open and a closed state, located in the sixth conduit, the third valve only being in the open state in response to the liquid/vapor sensor detection of refrigerant from the first container in the vapor state.

8. The apparatus of claim 7 further comprising a filter having an inlet and an outlet, the inlet of the filter being in fluid communication with the outlet of the condenser through a seventh conduit, and the outlet of the filter being in fluid communication with the second container through an eighth conduit.

9. The apparatus of claim 7 wherein the second and third valves are solenoid valves and are electrically coupled with the liquid/vapor sensor.

10. The apparatus of claim 7 further comprising a ninth conduit in fluid communication between the third and sixth conduits;

a fourth valve, actuatable between an open and a closed state, located in the ninth conduit;

a tenth conduit in fluid communication between the discharge side of the compressor and the second container;

a fifth valve, actuatable between an open and a closed state, located in the tenth conduit.

11. The apparatus of claim 10 further comprising a switch which selectively actuates the first, second and third valves to the closed state, and actuates the fourth and fifth valves to the open state to clear trapped refrigerant from the apparatus.

12. The apparatus of claim 7 further comprising a second filter located between the outlet of the first path of the heat exchanger and the suction side of the compressor.

13. The apparatus of claim 1 in combination with the first and second containers, and wherein the discharge side of said compressor is in fluid communication with the second container, and wherein said liquid/vapor sensor is connected to the first container, and wherein said heater is located between the first container and the suction side of the compressor, and wherein said apparatus further comprises a filter having an inlet and an outlet, the inlet of the filter being in fluid communication with the outlet of the condenser, and the outlet of the filter being in fluid communication with the second container.

14. The invention of claim 13 wherein the filter comprises a molecular sieve.

* * * * *